US005706252A

United States Patent [19]

Le Verrier et al.

[11] Patent Number: 5,706,252

[45] Date of Patent: Jan. 6, 1998

[54] WIDEBAND MULTIFREQUENCY ACOUSTIC TRANSDUCER

[75] Inventors: Bertrand Le Verrier, Golfe Juan; Gérard Roux, Le Rouret; Bruno Tardy, Cagnes s/Mer; Alphonse Ramos, Vence, all of France

[73] Assignee: Thomson-CSF, Paris, France

[21] Appl. No.: 750,862

[22] PCT Filed: Jun. 16, 1995

[86] PCT No.: PCT/FR95/00800

§ 371 Date: Jan. 6, 1997

§ 102(e) Date: Jan. 6, 1997

[87] PCT Pub. No.: WO96/01702

PCT Pub. Date: Jan. 25, 1996

[30] Foreign Application Priority Data

Jul. 8, 1994 [FR] France ..... 94 08474

[51] Int. Cl.[6] ..... H04R 17/00

[52] U.S. Cl. ..... 367/152; 367/157; 367/162; 367/151; 310/334; 310/335; 310/337

[58] Field of Search ..... 367/152, 157, 367/162, 151; 310/334, 335, 337

[56] References Cited

U.S. PATENT DOCUMENTS

| | | | |
|---|---|---|---|
| 5,410,205 | 4/1995 | Gururaja | 310/328 |
| 5,418,759 | 5/1995 | Fiebiger et al. | 367/140 |
| 5,629,906 | 5/1997 | Sudol et al. | 367/162 |

*Primary Examiner*—J. Woodrow Eldred
*Attorney, Agent, or Firm*—Oblon, Spivak, McClelland, Maier & Neustadt, P.C.

[57] ABSTRACT

The invention relates to multifrequency acoustic transducers exhibiting a wide band around each resonant frequency. It consists in inserting between a λ/2 active emitter plate (201) and the soft reflector (203) which supports it a rear plate (202) resonating in λ/4 mode and in placing on this active plate two marcher plates (204, 205) whose impedances are designed so as to best match the two frequencies obtained by inserting this rear plate. Thicknesses of these marcher plates are optimized with the aid of a model of for example Mason type starting from a value close to λ/4 for the frequency to be matched. It makes is possible to construct sonar transducers which operate equally well in detection mode and in classification mode.

4 Claims, 2 Drawing Sheets

WIDEBAND MULTIFREQUENCY ACOUSTIC TRANSDUCER

Figure 1:
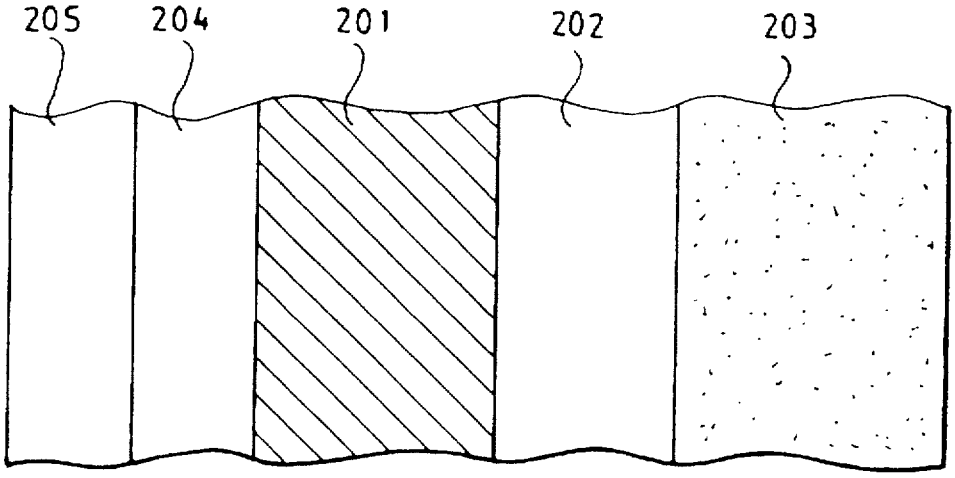

The present invention relates to acoustic transducers capable of operating on several emission frequencies and/or of receiving with wide passbands around these frequencies. It makes it possible in underwater imaging to obtain long range for low frequency, but with low resolution, and high resolution for high frequency, but with short range. Low-frequency operation is then used first to pinpoint the objects which it is desired to identify. The boat carrying the sonar equipped with this type of transducer subsequently approaches the object thus detected, and when sufficiently near, the high frequency is used making it possible to obtain an accurate image of this object.

It is known from French Patent Application Number 8707814, filed by the applicant on 4 Jun., 1987 and granted on 9 Dec. 1988 under the number 2616240, to fabricate a multifrequency acoustic transducer essentially intended to be used in medical uses, by inserting between the active piezoelectric plate and the reflector of an ordinary probe, a half-wave plate with the natural resonant frequency of this plate. The probe can thus be used at two distinct frequencies, one being substantially equal to half the other. However, this system, although it is well suited to medical imaging, in particular so as to use one frequency in imaging mode and the other frequency to view blood flows, exhibits a number of drawbacks in underwater imaging. In particular, the bandwidth around one of the two resonant frequencies is relatively small. This is not very important in respect of the frequency used to view blood flows. In underwater imaging, by contrast, the processing operations used make it necessary to have a large bandwidth for both frequency ranges.

To alleviate these drawbacks, the invention proposes a wideband multifrequency acoustic transducer, of the type comprising a piezoelectric emitter plate of impedance Z and resonating in $\lambda/2$ mode at a fundamental frequency F0, a rear plate of impedance Z3 and a support forming a reflector of the type with substantially zero impedance, characterized in that the rear plate resonates in $\lambda/4$ mode at the frequency F0 so as to make it possible to obtain two resonant frequencies FA and FB of the assembled transducer, and in that this transducer furthermore comprises two front matcher plates whose impedances Z1 and Z2 are given by the formulae $$Z1=Z0^{3/5}\times Z^{2/5}$$

$$Z2=Z0^{2/5}\times Z^{3/5}$$

and whose thicknesses enable them to resonate at frequencies substantially equal to $\lambda/4$ for respectively each of the frequencies FA and FB and to be substantially transparent for respectively each of the other frequencies; these thicknesses being optimized with the aid of a Mason type model.

According to another characteristic, the rear plate is formed from the same material as the active plate.

According to another characteristic, the material constituting the active layer and the rear plate is a ceramic of the PZT type for which Z is substantially equal to $21\times10^6$ acoustic ohms, the matcher plates have respective impedances $Z1=3.9\times10^6$ acoustic ohms and $Z2=6\times10^6$ acoustic ohms, and the thicknesses of these plates are respectively equal as a function of the frequency which they are required to match to $e1=\lambda/2.16$ and $e2=\lambda/5.04$ at the 1st frequency, and to $e1=\lambda/3.77$ and $e2=\lambda/8.81$ at the 2nd frequency.

According to another characteristic, the active plate has a thickness such that it resonates in $\lambda/2$ mode at a frequency of 250 kHz and in that the two frequencies of emission for which the transducer is matched are substantially equal to 350 kHz and 150 kHz.

Figure 2:
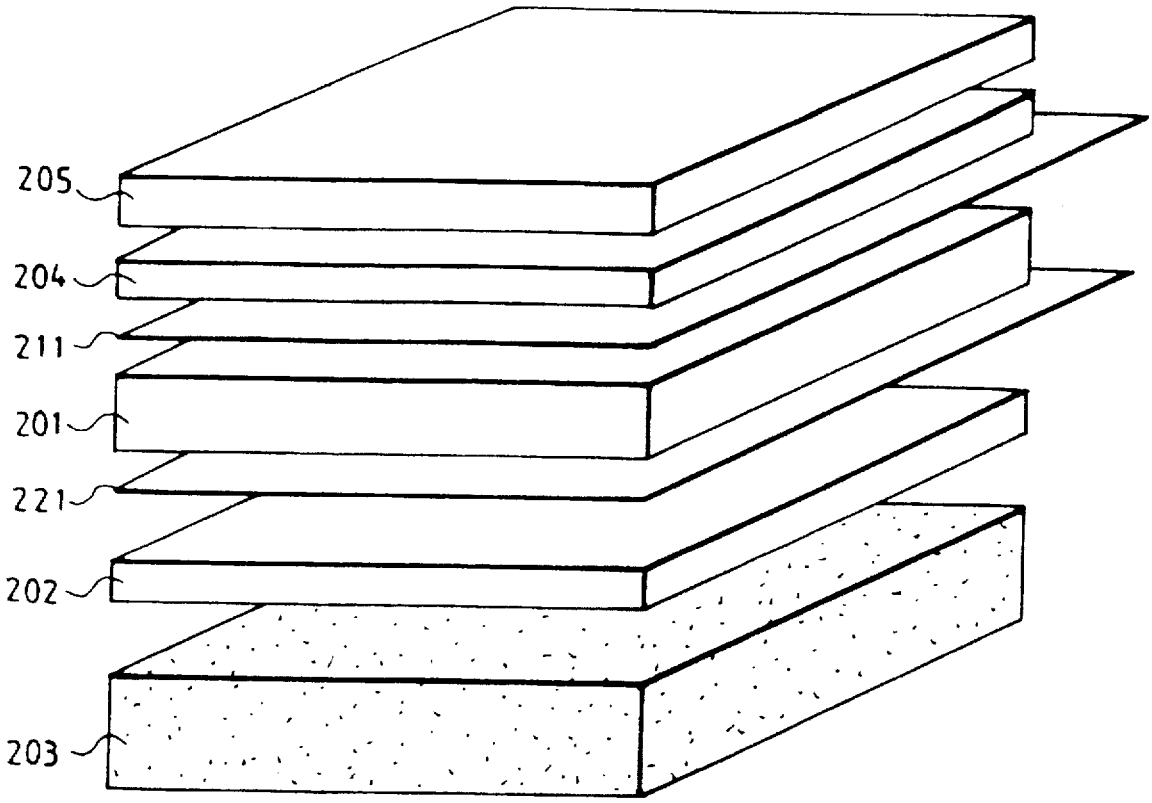
Figure 3:
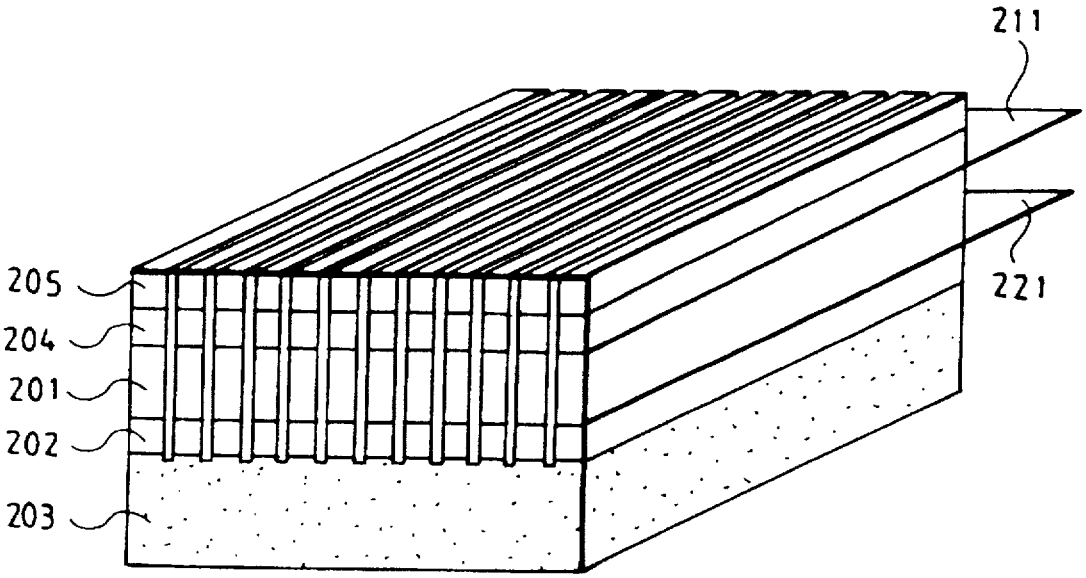

Other features and advantages of the invention will emerge clearly in the following description presented by way of non-limiting example with regard to the appended figures which represent:

FIG. 1, a sectional view of the structure of an antenna according to the invention;

FIG. 2, an exploded perspective view of the various layers, constituting this antenna; and FIG. 3, a perspective view of such a transducer after slicing to obtain columns necessary in the case of an application to a sonar.

Represented in FIG. 1 is a section taken through the thickness of a transducer according to the invention.

The active element of the transducer is composed of a piezoelectric ceramic plate 201 which resonates in $\lambda/2$ mode at a "natural" frequency F0 when it is isolated. This plate is fixed on a support 203 by way of a rear plate 202 which itself resonates in $\lambda/4$ mode at F0. The support 203 itself constitutes a reflector of the substantially zero impedance type, known in particular by the English term lightweight "backing", or soft reflector. To obtain such a substantially zero impedance with a material strong enough to bear the transducer, a low-density cellular material is used according to the known art.

Adding the resonating rear plate 202 to the piezoelectric ceramic plate 201 makes it possible to obtain two resonant frequencies FA and FB for the unit as a whole, such that FA lies between 1.5 FB and 3 FB. Furthermore (FA+FB)/2=F0.

So as to improve the behaviour of the transducer, in particular its matching with respect to the medium, generally water, in which it is required to emit, as well as the obtaining of sufficient bandwidths around the two resonant frequencies FA and FB defined above, two front marcher plates 204 and 205, each of quarter-wave type at the two frequencies FA and FB respectively, are overlaid on the front emitter face of the plate 201.

Denoting by Z the impedance of the piezoelectric ceramic, by Z0 the impedance of the exterior medium into which the acoustic waves are emitted, and by Z3 the impedance of the rear plate 202, it may be shown that an apt choice of the impedance of the rear plate, Z and Z0 being in principle determined by materials used, makes it possible to choose the ratio of frequencies FA/FB. Thus, to cover an FA/FB span of from 1.5 to 3, it is appropriate to choose Z3 between Z/6.2 and Z×4.6.

In the prior art it was known how to match just a single of the two frequencies by using a single front matcher plate, except in certain particular numerical cases, for example when FA/FB=3.

To match both frequencies, the invention therefore proposes to use two front marcher plates 204 and 205, making each plate particular to one frequency in such a way that one of the plates matches the device in respect of one of the frequencies and the other plate in respect of the other frequency. In fact, given that these plates are overlaid, their behaviours interfere with one another, essentially insofar as the plates are not completely transparent to the frequencies in respect of which they are not matched.

It is therefore desired simultaneously to meet several criteria:

- that each plate taken separately should effect impedance matching at the frequency assigned to it;
- that the transmission of acoustic energy emitted by the piezoelectric ceramic 201 should be optimized towards the front medium.

Research by the inventors has culminated in determining the impedances of the two plates according to the following two formulae:

$$Z1 \cong Z0^{3/5} \times Z^{2/5}$$

$$Z2 \cong Z0^{2/5} \times Z^{3/5}$$

Furthermore, the invention proposes that the thicknesses of the two front plates be close to a quarter of the wavelength of the frequencies FA and FB, and that their exact values be obtained from the use of a well-known model based on the equivalent diagrams published by W. P. MASON in Physical Acoustics Principles and Methods 1964—Academy Press.

By way of example embodiment, use was made of a plate 202 made of piezoelectric ceramic of the PZT type exhibiting an impedance substantially equal to $21\times10^6$ acoustic ohms. The thickness of the plate is chosen so that it resonates in $\lambda/2$ mode at a frequency F0=250 kHz.

The rear plate is designed to resonate in $\lambda/4$ mode at this same frequency, and the invention proposes by way of improvement to fabricate this plate from the same ceramic, of the PZT type, as that used for the active piezoelectric plate 201. This makes it possible to a large extent to simplify the fabrication of the transducer.

Under these conditions, values substantially equal to 350 kHz and to 150 kHz respectively will be obtained for the two frequencies FA and FB. It is clear that FO is substantially equal to (FA+FB)/2 and that furthermore FA/FB is substantially equal to 2.33.

The plates 204 and 205 are made, according to the known art, from materials whose composition makes it possible to obtain the desired acoustic impedances. These impedances will be chosen, in accordance with the formulae cited earlier, to have values $Z1=3.9\times10^6$ acoustic ohms and $Z2=6\times10^6$ acoustic ohms.

The use of the Mason type model to define the thicknesses of these two plates gives results, expressed in wavelength, equal to:

For FA=350 kHz, $e1=\lambda/2.16$ and $e2=\lambda/3.77$

For FB=150 kHz, $e1=\lambda/5.04$ and $e2=\lambda/8.81$

It is therefore observed that in effect for each of the frequencies chosen, the corresponding matcher plate has a thickness substantially equal to $\lambda/4$, this procuring the desired matching, and that at the other frequency, the thickness of the plate is close to $\lambda/2$ for one, and less than $\lambda/8$ for the other, thus rendering them substantially transparent to the acoustic waves for the frequencies which they are required not to disturb.

The variations with respect to $\lambda/4$ and to $\lambda/2$ originate precisely from the interaction between the various layers, the effect of which is modelled by the Mason type model.

Measurements performed on a transducer constructed according to these characteristics have shown that the bandwidths obtained were greater than 20% for FA and greater than 50% for FB, this being entirely satisfactory.

In order to make a transducer using this structure, a succession of plates of the chosen materials with the thicknesses thus determined are stacked, as represented in FIG. 2, furthermore interposing electrodes 211 and 221 formed from a slender conducting metallic layer which does not disturb the acoustic operation of the unit as a whole, between the ceramic 201 and the layer 204 on the one hand, and between this ceramic and the layer 202 on the other hand. These electrodes 211 and 221 jut out from the sandwich in such a way as to be accessible so that they can be connected to the leads delivering the signal intended to excite the ceramic 201. These various plates are glued together, and the sandwich thus obtained is subsequently sliced into columns as represented in FIG. 3, so as to obtain the structure of the transducer necessary to obtain correct emission of the acoustic waves through the front face, according to techniques well known in sonar.

We claim:

1. Wideband multifrequency acoustic transducer, of the type comprising a piezoelectric emitter plate (201) of impedance Z and resonating in $\lambda/2$ mode at a fundamental frequency F0, a rear plate (202) of impedance Z3 and a support (203) forming a reflector of the type with substantially zero impedance, characterized in that the rear plate (202) resonates in $\lambda/4$ mode at the frequency F0 so as to make it possible to obtain two resonant frequencies FA and FB of the assembled transducer, and in that this transducer furthermore comprises two front marcher plates (204, 205) whose impedances Z1 and Z2 are given by the formulae $$Z1 \cong Z0^{3/5} \times Z^{2/5}$$

$$Z2 \cong Z0^{2/5} \times Z^{3/5}$$

and whose thicknesses enable them to resonate at frequencies substantially equal to $\lambda/4$ for respectively each of the frequencies FA and FB and to be substantially transparent for respectively each of the other frequencies; these thicknesses being optimized with the aid of a Mason type model.

2. Transducer according to claim 1, characterized in that the rear plate (202) is formed from the same material as the active plate (201).

3. Transducer according to claim 2, characterized in that the material constituting the active layer (201) and the rear plate (202) is a ceramic of the PZT type for which Z is substantially equal to $21\times10^6$ acoustic ohms, in that the marcher plates (204, 205) have respective impedances $Z1=3.9\times10^6$ acoustic ohms and $Z2=6\times10^6$ acoustic ohms, and in that the thicknesses of these plates are respectively equal as a function of the wave frequency which they are required to match to $e1=\lambda/2.16$ and $e2=\lambda/5.04$ at the 1st frequency, and to $e1=\lambda/3.77$ and $e2=\lambda/8.81$ at the 2nd frequency.

4. Transducer according to claim 4, characterized in that the active plate (201) has a thickness such that it resonates in $\lambda/2$ mode at a frequency of 250 kHz and in that the two frequencies of emission for which the transducer is matched are substantially equal to 350 kHz and 150 kHz.

* * * * *